United States Patent [19]

Iwata

[11] Patent Number: 5,014,602

[45] Date of Patent: May 14, 1991

[54] HYDRAULIC CYLINDER UNIT CAPABLE OF BEING SET IN THREE POSITIONS

[75] Inventor: Yukio Iwata, Omiya, Japan

[73] Assignee: Akebono Brake Industry Co., Ltd., Tokyo, Japan

[21] Appl. No.: 464,883

[22] Filed: Jan. 16, 1990

[30] Foreign Application Priority Data

Jan. 13, 1989 [JP] Japan ..... 1-4854

[51] Int. Cl.[5] ..... F01B 15/02

[52] U.S. Cl. ..... 92/117 A; 92/51; 92/166

[58] Field of Search ..... 92/51, 66, 117 R, 117 A, 92/166; 91/176

[56] References Cited

U.S. PATENT DOCUMENTS

| | | | |
|---|---|---|---|
| 2,550,925 | 5/1951 | Weimar | 92/117 R |
| 2,806,449 | 9/1957 | Simmons | 92/52 |
| 3,913,457 | 10/1975 | Hawley | 92/66 |
| 3,968,735 | 7/1976 | Boisde et al. | 92/62 |
| 4,002,105 | 1/1977 | Bell et al. | 92/62 |

FOREIGN PATENT DOCUMENTS

| | | |
|---|---|---|
| 3213758 | 4/1982 | Fed. Rep. of Germany . |
| 1395635 | 1/1964 | France . |
| 770184 | 3/1954 | United Kingdom . |
| 771762 | 3/1954 | United Kingdom . |
| 2138505 | 4/1983 | United Kingdom . |

*Primary Examiner*—Edward K. Look
*Assistant Examiner*—John Ryznic
*Attorney, Agent, or Firm*—Cushman, Darby & Cushman

[57] ABSTRACT

A hydraulic cylinder that is capable of being set in three positions utilizing a movable cylinder with a fixed main piston and auxiliary pistons slidably mounted within the cylinder. Right and left fluid chambers are defined, within the cylinder, by the main piston and right and left auxiliary pistons respectively.

5 Claims, 1 Drawing Sheet

HYDRAULIC CYLINDER UNIT CAPABLE OF BEING SET IN THREE POSITIONS

BACKGROUND OF THE INVENTION

1. Field of the invention

The present invention relates generally to a so-called three position hydraulic cylinder that is capable of being set at three positions, both end positions and a center position. In particular, the present invention relates to a three position hydraulic cylinder that is able to be manufactured in small sizes and allows easy preadjustment of all three positions.

2. Description Of The Related Art

Hydraulic cylinders that are capable of three set positions are well known in the prior art. Applications for such a device include actuators of cargo moving mechanisms or power cylinders for lift mechanism sorters the like. The conventional hydraulic cylinder of this type is actually composed of two cylinders in combination provided separately with each other. Pressure is selectively applied to one of the right or left cylinders to cause a stroke in those respective directions. When pressures are applied to both cylinders the device is set in the middle position.

The above-mentioned combination of two cylinders occupies a large area and is high in cost. Such is disadvantageous.

SUMMARY OF THE INVENTION

Accordingly, it is an object of the present invention to allow the manufacture of a hydraulic cylinder capable of being set in three positions that is smaller and less expensive than similar devices found in the prior art and is capable of being easily preadjusted to different set positions.

The hydraulic cylinder unit according to the present invention overcomes the shortcomings of similar devices accompanying the prior art because of a single cylinder design. It utilizes a movable cylinder with a fixed main piston and auxiliary pistons slidably mounted within the cylinder. Right and left part of a fluid chamber are defined, within the cylinder, by the main piston and right and left auxiliary pistons respectively.

When a working fluid is introduced into one part of the fluid chamber, the respective auxiliary piston is moved, together with the cylinder, in one direction until contacting a stopper. To set the cylinder in a central position, working fluid is introduced into both part of the fluid chamber. In this situation both auxiliary pistons will extend outward from the cylinder setting the cylinder in a central position.

Other objects, features and characteristics of the present invention, as well as the methods of operation and function of the related elements of the structure, and the combination of parts and economies of manufacture, will become more apparent upon consideration of the following detailed description and the appended claims with reference to the accompanying drawings all of which form a part of this specification.

DETAILED DESCRIPTION OF THE PREFERRED EMBODIMENT

Figure 1:
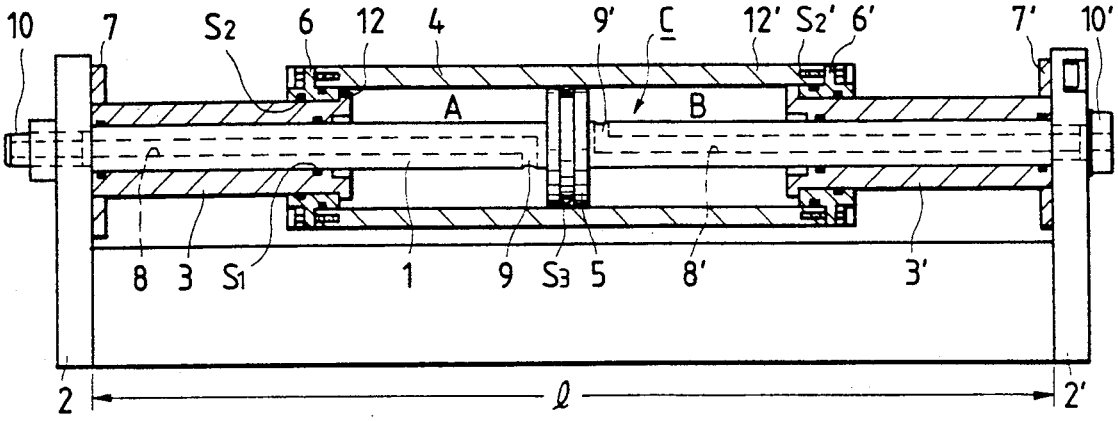
FIG. 1 is s sectional view of the preferred embodiment set in the center position.

FIG. 1 illustrates a hydraulic cylinder according to a preferred embodiment of the present invention set in the center position.

A piston rod 1 fixedly mounts a main piston 5 at a center thereof. The piston rod 1 is secured at one end to bracket 2 and at the other end to a bracket 2'. If the diameter and material of the piston rod 1 is chosen so as to provide sufficient rigidity, the piston rod 1 may be secured at only one end to one of the bracket 2 or 2' thus being supported as a cantilever. A seal ring $S_3$ is provided on the circumferential edge of the main piston 5 so that a fluid contained in a chamber A does not leak to a chamber B. Auxiliary pistons 3 and 3' are slidably fitted on respective sides of the piston rod 1. One on each side of the main piston 5. Each auxiliary piston 3 and 3' have an annular projection 12 and 12' on the end closest to the main piston 5 and a fluid tight seal ring $S_1$ at the interface of the piston rod 1 and the auxiliary piston 3 to prevent leakage there between.

A movable cylinder 4 is fitted over the main piston 5 and portions of auxiliary pistons 3 and 3' defining the fluid chamber A and chamber B. Collars 6 and 6' are secured on the ends of the movable cylinder 4 and slidably fitted over the auxiliary pistons 3 and 3'. One of the collars 6 and 6' may selectively be formed integrally with the movable cylinder 4. Seal rings $S_2$ and $S_2'$ are provided in the collars 6 and 6' to maintain pressure within the fluid chambers A and B.

Stopper rings 7 and 7' are secured to the insides of brackets 2 and 2', for the purpose of providing an end stop for the movable cylinder 4. The stoppers 7 and 7' may be or may not be ring-shaped. However, the stoppers may preferably be ring-shaped in order to increase an area abutting against the movable cylinder 4. The inside diameters of the stopper rings 7 and 7' are made a little larger than the outside diameter of the auxiliary pistons 3 and 3', respectively, so as not to interfere with the auxiliary pistons 3 and 3' coming into abutment against the brackets 2 and 2', respectively. If the brackets 2 and 2' are to act as stoppers for the auxiliary piston 3 and 3', respectively, a distance l between the bracket 2 and the bracket 2' is determined as such.

The piston rod 1 is provided with fluid channels 8 and 8' along a center axis thereof and supply holes 9 and 9' communicating with the fluid channels 8 and 8', respectively, which holes are disposed adjacent to the main piston 5. The fluid channels 8 and 8' together with the supply holes 9 and 9' allow the working fluid to be introduced into the fluid chambers A and B, respectively. Each of the auxiliary pistons 3 and 3' is provided with a large inside diameter portion in order that the holes are not covered by the auxiliary pistons 3 and 3', respectively, when the pistons moves to leftmost or rightmost end. The member for introducing the working fluid into the fluid chambers is not limited to the fluid channels. That is, the introducing member may be flexible hosepipes if they are sufficient with respect to mechanical strength.

The movable cylinder 4, main piston 5, auxiliary pistons 3 and 3', and collars 6 and 6' constitute fluid chambers A and B, respectively.

The working fluid is introduced into the fluid chambers A and B through ports 10 and 10', fluid channels 8 and 8', and supply holes 9 and 9', respectively.

Figure 2:
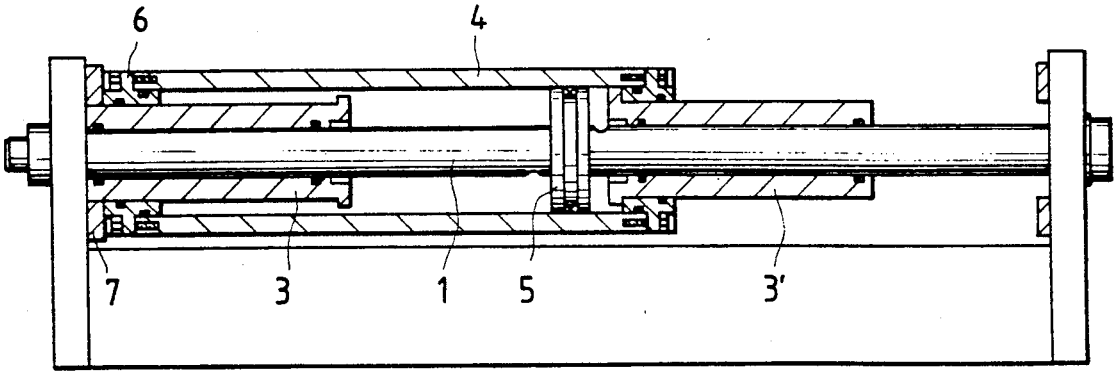
FIG. 2 is a sectional view of the preferred embodiment set in one of two side positions.

When the working fluid is introduced into fluid chamber A through port 10, channel 8 and supply hole 9, the auxiliary piston 3 and the movable cylinder 4 are moved to the left as illustrated in FIG. 2. After the auxiliary piston 3 comes into contact with the bracket 2 the movable cylinder 4 will continue to move to the left due to pressure exerted on the collar 6. The auxiliary piston 3 will retreat into the cylinder 4. The auxiliary piston 3' will also be moved to the left along with the movable cylinder 4 due to the interaction between the projection 12' and the collar 6'. At the same time working fluid is drained from fluid chamber B through supply hole 9', fluid channel 8' and port 10'. Through this process the cylinder has been set in the first position.

On the other hand, the cylinder is set in the second position by introducing working fluid into fluid chamber B through port 10', fluid channel 8' and supply hole 9' while draining fluid from fluid chamber A through supply hole 9 fluid channel 8 and port 10. The cylinder will then move to the right, in a corresponding manner, until the movable cylinder 4 abuts against the bracket 2'. The result is that the cylinder is set in the second position (not shown). After that, merely the movable cylinder 4 further moves rightward due to the pressure applied to the collar 6'.

The center, or third, set position is accomplished by introducing fluid into both fluid chambers A and B so as to have equal pressure therein. The auxiliary pistons 3 and 3' will be forced outwards, away from the main piston 5, until contacting the brackets 2 and 2', respectively. Simultaneously the collars 6 and 6' are forced against the projections 12 and 12' firmly locking the cylinder in the central position.

Other embodiments of the present invention may include a cylinder that is fixed and a movable piston rod. The central position of the cylinder can be accurately preadjusted through the use of shims interposed between the collars 6 and 6' and the ends of the cylinder 4. Similarly, the end positions of the cylinder can be preadjusted by the use of stoppers of a desired thickness between the brackets 2 and 2' and the cylinder 4.

If only one end of the piston 1 is fixed to the corresponding bracket, a stopper plate should be secured to the other end of the piston 1, and a stopper ring should be fixedly mounted inside the stopper plate.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims. For example, while the preferred embodiment utilizes a movable cylinder and a fixed piston the present invention may be otherwise embodied with a movable piston and a fixed cylinder.

What is claimed:

1. A fluid cylinder unit capable of being set in three set positions, comprising:

a piston rod including a main piston extending radially therefrom at a central position along said piston rod, two auxiliary pistons slidably mounted on said piston rod, one on each side of said main piston, each of said auxiliary pistons having an annular projection extending radially therefrom at an end closest to said main piston, a cylinder arrangement, comprising;

a tubular cylinder slidably mounted around said main piston and at least a portion of each of said auxiliary pistons;

two collars, one on each end of said cylinder, the inside diameter of said two collars being smaller than the outer diameter of said annular projections so as to prevent said auxiliary pistons from exiting said cylinder completely; and two seals, one on each of said collars, fitted against each of said auxiliary pistons so as to define a fluid-tight chamber on the right side of said piston and a fluid-tight chamber on the left side of said main piston;

means for limiting the travel of said cylinder, relative to said piston rod, along the length of said piston rod; and;

pumping means for introducing fluid into, and draining fluid out of, each of said fluid tight chambers so as to cause said cylinder to be moved to an extreme right position until said cylinder encounters said means for limiting travel and said auxiliary piston on the right side to retreat into said cylinder when fluid is introduced into said fluid-tight chamber, on the right side and fluid is drained out of said fluid-tight chamber on the left side, said pumping means further causing said cylinder to be moved to an extreme left position unit said auxiliary piston on the left side to retreat into said cylinder, when fluid is introduced into said fluid-tight chamber on the left side and fluid is drained out of said fluid-tight chamber on the right side, said pumping means further causing said cylinder to be moved to a central position and said annular projections to be forced against said collars when fluid is introduced into both of said fluid-tight chambers under equal pressure.

2. A fluid cylinder as described in claim 1, wherein said working fluid is a liquid.

3. A fluid cylinder as described in claim 1 wherein said working fluid is a gas.

4. A fluid cylinder as described in claim 1 wherein said cylinder is movable and said piston rod is fixed.

5. A fluid cylinder as described in claim 1 wherein said cylinder is fixed and said piston rod is movable.

* * * * *